United States Patent [19]

Rohleder et al.

[11] Patent Number: 4,702,949

[45] Date of Patent: Oct. 27, 1987

[54] WOVEN TEXTILE FABRICS, NAMELY VELOURS, AND METHOD FOR ITS MANUFACTURE

[76] Inventors: Klaus Rohleder, Klausenhof 2; Willi Stark, Wichernstrasse 21, both of D-8684 Konradsreuth, Fed. Rep. of Germany

[21] Appl. No.: 908,286

[22] Filed: Sep. 17, 1986

[30] Foreign Application Priority Data

Oct. 31, 1985 [DE] Fed. Rep. of Germany ..... 3538794

[51] Int. Cl.[4] ..... B32B 3/02; B32B 33/00

[52] U.S. Cl. ..... 428/92; 428/93; 428/94; 428/95; 26/2 R

[58] Field of Search ..... 428/92, 93, 94, 95; 26/2 R, 51; 28/162

[56] References Cited

U.S. PATENT DOCUMENTS 3,024,518 3/1962 Newton ..... 428/95

4,617,218 10/1986 Cadenhead ..... 428/17

*Primary Examiner*—Marion C. McCamish

*Attorney, Agent, or Firm*—Robin, Blecker & Daley

[57] ABSTRACT

A woven fabric, namely a velours, consists of a foundation fabric and a pile layer of synthetic fibers, at least the pile fibers having a strong crinkle in the untreated woven state. The fiber sections of the pile fibers projecting out of the foundation fabric are permanently uncrinkled, straightened and largely paralleled in the nap surface area and assume an essentially straight position while the pile fibers in the area of the foundation fabric still have the initial crinkle. Due to this, a very easy-to-care-for velours is created with excellent pile retention in the foundation fabric.

15 Claims, 3 Drawing Figures

WOVEN TEXTILE FABRICS, NAMELY VELOURS, AND METHOD FOR ITS MANUFACTURE

FIELD OF THE INVENTION

The invention relates to a woven textile fabric, namely velours, with a foundation fabric and pile of synethetic fibers, the pile fibers being strongly crinkled in untreated woven state. The invention relates further to a production method for such velours.

BACKGROUND OF THE INVENTION

Known in the state of the art are synthetic velours materials where foundation fabric and/or pile fibers consist of synthetic fibers. As compared to velours of wool, cotton, linen or rayon, such materials are easier to care for and their resistance to mechanical abrasion is better. These materials tend to have a certain susceptibility to soiling because the pile fibers are strongly crinkled over the entire pile fiber length in untreated woven condition. Said crinkle is indispensable because smooth pile fibers would not hold in the foundation fabric and thus the pile would be pulled out of the foundation fabric under relatively small mechanical stress on the pile.

Attempts have been made already to weave smooth endless yarns and link them to the foundation fabric in a special way, but this causes relatively high production costs and a really secure hold of the too smooth pile in the foundation fabric is not assured. While a certain hold of the smooth pile in the foundation fabric can be achieved by coating in the area of the foundation fabric, such materials lose suppleness and textile feel thereby. For this reason, the crinkled pile fibers have always been returned to in high-grade, synthetic velours. But due to their strong inherent crinkle and surface roughness, necessary for pile retention and seam strength, they tend to soil.

SUMMARY OF THE INVENTION

It is an object of the invention to create a velours which can be subjected to high mechanical stress, is particularly easy to clean and is relatively soft and supple to the touch.

In attaining this object, practice is provided to smooth, straighten and parallel the pile fibers after the weaving operation in which the pile is hooked into the foundation fabric, as it were, in the nap surface area only, which is the pile fiber area reaching almost to the foundation fabric, which is accomplished by thermal and aimed, mechanical influences. Mechanical influence means a short tension is exerted on the pile fibers in the longitudinal direction of the fibers; thermal influence means that the pile fibers, while under tension, are briefly heated to the point where first thermoplastic changes result in the fiber structure, leading to a permanent straightening of the fiber, to a surface smoothing of the fiber and to an extensive mutual paralleling of the pile fibers. This gives the fabric a very smooth, silky impression and an exceedingly beautiful sheen. Since the crinkle in the pile fiber end section area is gone, it is much harder for dirt fiber particles to deposit in the pile than is the case with the crinkled pile fibers. The brief application of mechanical and thermal energy to the pile fibers also results in the pile fiber sections which remain crinkled entering a very intimate bond with the likewise crinkled fibers of the foundation fabric which benefits the pile strength of the material.

The face that the straightened, uncrinkled, free pile fiber sections are stiffer than the crinkled sections is another advantage, especially in combatting seat shine. The greater stiffness gives the pile more body, even under great permanent stress, so that the above described quality properties of the material are secured also over the long term.

Due to the special treatment of the free pile fiber ends which in the straightening operation are not only uncrinkled but also surface smoothed it is possible to achieve a very silky pile surface sheen despite the use of matted polyacryl fibers.

It is also of particular advantage in the velours according to the invention that—in contrast to surface-treated fibers such as fibers that have been given a dirt repelling finish which will be gone after a few cleaning operations - the velours according to the invention retains its initial qualities also after many cleanings.

The removal of dirt particles rubbed into the nap, in other words the cleaning behavior of the velours, is improved. Dirt can be shampooed from the nap again relatively simply or extracted by spray action.

By appropriately selecting the reaction temperature and the pressure acting upon the pile fibers in longitudinal direction it can further be achieved that the V or W shape (depending on whether V-nap or W-nap is being woven) of the pile fiber sections remaining crinkled are form-stabilized in the area of contact with the foundation fabric, whereby the pile retention is improved quite significantly.

If very fine-denier pile fibers of about 3.3 den fiber thickness are used as pile fiber, the straightening and stiffening of the pile fibers, in conjunction with a subsequent thermofixation, have a particularly advantageous effect on the prevention of seat shine which fine-denier woven velours materials otherwise tend to develop.

It is to be noted that the recommendations of the fiber manufacturers basically are not to heat polyacryl fibers suited and produced for use in woven velours fabrics beyond a temperature of 185° C. max. in dry state, because no guarantee is assumed for color fastness and fiber structure. This recommendation, based on certain prejudices, is broken in the production method of the velours, though restricted to very short time spans. Smoothing, straightening and paralleling of the pile fiber ends is expediently accomplished by a rotating, heated roller made available separately for this straightening operation, or else by a heated pile rotor otherswise used for precleaning and aligning the pile. To date, a pile rotor has not been employed for the permanent straightening of pile ends of synthetic fibers by briefly overheating them in controlled manner.

Other possibilities of supplying heat to the fabric briefly and during the fiber straightening operation are the application of heat to pile fiber ends through directed heat radiation, limited timewise and spacewise or through an aimed hot air jet.

Protracted test series have shown that a preferred temperature for the attainment of the desired straightening effect is a fiber heating temperature of about 200° C. However, it must be noted here that deviations from this mean temperature may be expedient when fibers of a different fiber thickness or structure are to be smoothed. Basically, the temperature should be selected so that the straightening of the fibers in the area of the free pile ends remains intact permanently while the crinkling and other physical properties of the pile material in the binding area remain unchanged, which would lead to a drastic worsening of the pile retention or of the textile properties of the woven material.

The velours gains a particularly silky, supple structure friendly to the touch when heated in the tenter uniformly at about 190° C. for a somewhat longer time. This leads to a significant improvement of the pile retention by further fixation of the pile nap shape (V or W shape). In addition, the aleady straightened pile fiber sections are fixed further.

DESCRIPTION OF PREFERRED EMBODIMENTS AND PRACTICES

The invention is explained in greater detail in the figures of the drawing by way of an embodiment example.

Figure 1:
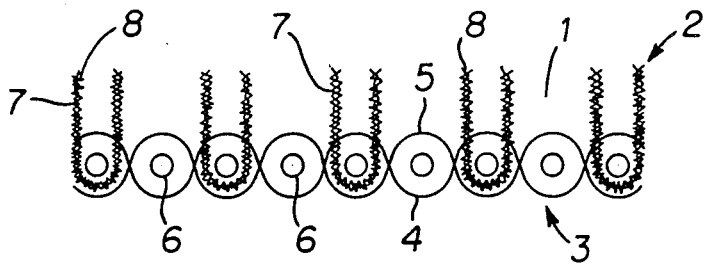
FIG. 1 shows a schematic, sectioned view of a woven velours fabric prior to the execution of the treatment steps according to the invention.
Figure 2:
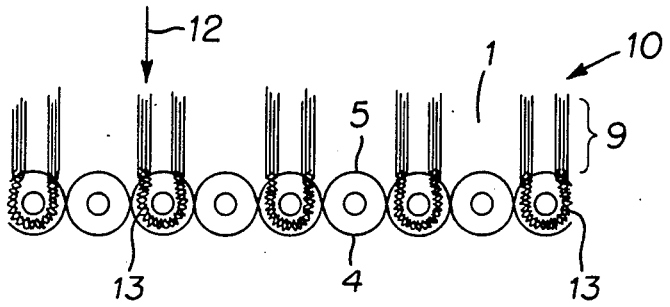
FIG. 2 shows a view according to FIG. 1 after the execution of the treatment steps according to the invention.
Figure 3:
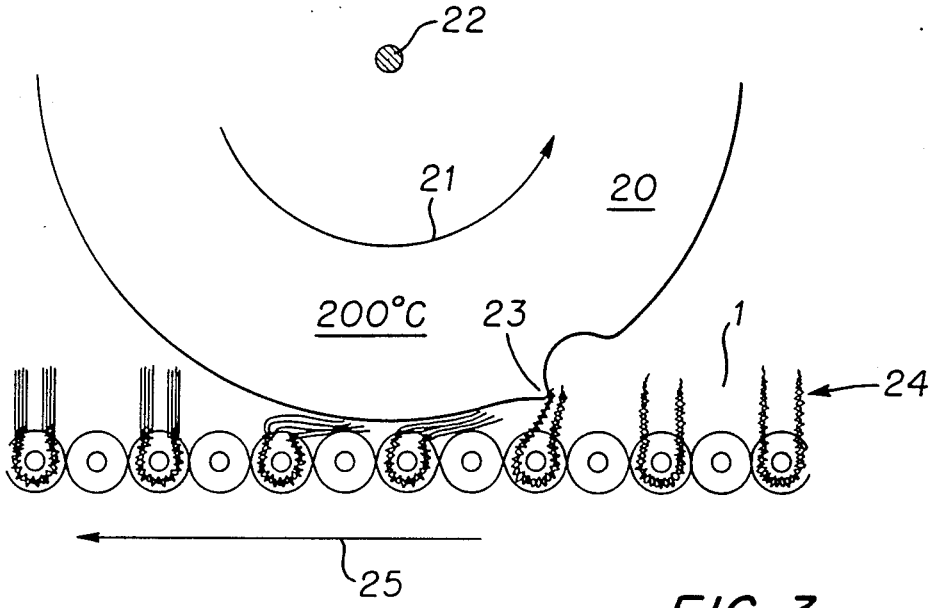
FIG. 3 shows a view according to FIGS. 1 and 2 with rotating and heated pile roller engaging the fiber ends.

The woven fabric shown in FIGS. 1 through 3 is a velours and consists of a foundation fabric 2 and a pile layer 3. At least the pile layer 3 consists of synthetic fibers, namely polyacryl. The embodiment example shown involves a V-nap velours in which both figure warp 4 and binding warp 5 have the same basic tension. The respective weft is designated 6. It is noted at this point that differently woven velours, e.g., with different basic warp tensions, other nap bonds or nap shapes, also W-naps, may be used just as well in connection with the invention.

It may be seen clearly in FIG. 1 that the pile fibers 7 have a strong crinkle or initial crinkle 11 over their entire length, i.e., up to their free ends 8.

It may be seen clearly in FIG. 2 that the fiber sections 9 of the pile fibers 7 projecting out of the foundation fabric 2 are permanently uncrinkled, straightened and largely paralleled in the nap surface area 10, essentially assuming a straight position while the pile fibers 7 still have their intitial crinkle 11 in the area where they are bound to the foundation fabric. The free ends, of the pile fibers 7 projecting out of the foundation fabric 2 have a greater bending stiffness than the crinkled fiber sections located in the area of the foundation fabric 2 and can be relatively highly stressed in compression by a force acting on them in arrow direction 12. Also, the free ends of the pile fibers 7 have less surface roughness than the crinkled fiber sections located in the area of the foundation fabric 2. The V-shaped sections 13 of the pile nap are fastened to the foundation fabric 2 in the binding area so as to be dimensionally stable, i.e., if a nap is pulled out of its binding with the foundation fabric, it will retain its original V shape.

The pile fibers 7 have a fiber thickness of approx. 3.3±0.5 den. Matted polyacryl fibers are used as pile fibers 7.

Shown in FIG. 3 is a pile roller 20 which revolves in arrow direction 21 about its axis 22 and is equipped with a protrusion 23 which wipes through the nap layer 24 of the velours which is pulled in arrow direction 25 under the pile roller. The pile fibers shown on the right are still crinkled over their entire length, the ones coming out from under the pile roller on the left are already smoothed. In the center section of the drawing it may be seen clearly that a tension in the longitudinal direction of the fibers is exerted on the pile nap sections projecting out of the foundation fabric while aplying heat at the same time, thereby smoothing them. It may be that after this smoothing operation the fibers assume a certain oblique position relative to the foundation fabric, but they can be returned to their completely erect position by intermediate steps. It is also plain from the center section of FIG. 3 that the free end sections of the fibers lay themselves prone and the remnant sections are thereby protected against the effect of the 200° C. temperature and, therefore, are not smoothed.

We claim:

1. A woven textile velours fabric comprising a foundation fabric and pile of synthetic fibers, at least the pile fibers being strongly crinkled in the untreated woven state, sections of the pile fibers projecting out of the foundation fabric characterized in that such projecting fiber sections are permanently uncrinkled, straightened and largely parallel in the nap surface area of said fabric in essentially straight disposition, while sections in the pile fibers in the area of the foundation fabric exhibit such strong crinkling.

2. The woven textile fabric according to claim 1, characterized in that free ends of the pile fibers are of greater stiffness that the crinkled fibers sections located in the area of the foundation fabric.

3. The woven textile fabric according to claim 1, characterized in that free ends of the pile fibers have less surface roughness than the crinkled fiber sections located in the area of the foundation fabric.

4. The woven textile fabric according to claim 1, characterized in that the V or W-shaped sections of the pile nap are fastened to the foundation fabric in the binding area so as to be dimensionally stable.

5. The woven textile fabric according to claim 4, characterized by the use of fine-denier pile fibers of a fiber thickness of 3.3±0.5 den.

6. The woven textile fabric according to claim 4, characterized by the use of matted polyacryl fibers as pile fibers.

7. A method of producing a woven textile velours fabric comprising the steps of:

(a) weaving crinkled synthetic pile fibers into a foundation fabric and (b) exerting mechanical force active in the longitudinal direction of the pile fibers such that the pile fibers are permanently smoothed, straightened and made at least partly parallel in the area of the free pile ends only, while remaining crinkled in the area of attachment thereof to the fabric.

8. The method according to claim 7, characterized in that the smoothing, straightening and paralleling of the pile fiber ends takes place under the effect of sudden, brief, mechanical pressure in the temperature range of first permanent thermoplastic changes in the pile fiber ends.

9. The method according to claim 8, characterized in that the smoothing, straightening and paralleling of the pile fiber ends takes place through the use of a rotating, heated roller with striplike protrusions which act upon the pile fibers ends cyclically, briefly and with the exertion of a tension acting in the longitudinal direction of the fibers.

10. The method according to claim 7, characterized in that the heat is applied to the pile fiber ends through directed heat radiation limited spacewise and timewise.

11. The method according to claim 7, characterized in that the heat is applied to the pile fiber ends through an aimed hot air jet.

12. The method according to claim 8, characterized in that the smoothing, straightening and paralleling of the pile fiber ends occurs through a heated pile rotor.

13. The method according to claim 7, characterized in that the temperature briefly supplied to the pile fiber ends for straightening, smoothing and paralleling is higher than 185° C.

14. The method according to claim 13, characterized in that the temperature is in the area of about 200° C.

15. The method according to claim 7, characterized by a thermal after-treatment of the synthetic velours made easy to care for by smoothing, straightening and paralleling the pile fiber ends in a tenter at about 190° for about 0.5 to 4 minutes.

* * * * *